US009442509B2

(12) United States Patent
Casagrande et al.

(10) Patent No.: US 9,442,509 B2
(45) Date of Patent: Sep. 13, 2016

(54) ELECTRONIC CIRCUIT WITH SELF-CALIBRATED PTAT CURRENT REFERENCE AND METHOD FOR ACTUATING THE SAME

(71) Applicant: The Swatch Group Research and Development Ltd, Marin (CH)

(72) Inventors: Arnaud Casagrande, Bole (CH); Jean-Luc Arend, Peseux (CH)

(73) Assignee: The Swatch Group Research and Development Ltd., Marin (CH)

( * ) Notice: Subject to any disclaimer, the term of this patent is extended or adjusted under 35 U.S.C. 154(b) by 118 days.

(21) Appl. No.: 14/558,839

(22) Filed: Dec. 3, 2014

(65) Prior Publication Data

US 2015/0177772 A1 Jun. 25, 2015

(30) Foreign Application Priority Data

Dec. 20, 2013 (EP) ..... 13198965

(51) Int. Cl.
*G05F 1/10* (2006.01)
*G05F 3/26* (2006.01)
*G05F 3/24* (2006.01)

(52) U.S. Cl.
CPC ..... *G05F 3/262* (2013.01); *G05F 3/242* (2013.01)

(58) Field of Classification Search
CPC ..... H05G 1/10; G05F 3/26
See application file for complete search history.

(56) References Cited

U.S. PATENT DOCUMENTS 6,844,711 B1 1/2005 Sutardja et al.
7,023,194 B1 4/2006 Sutardja et al.
7,076,384 B1 7/2006 Radulov et al.
7,579,822 B1 8/2009 Sutardja et al.
7,795,857 B1 9/2010 Sutardja et al.
8,237,492 B2 * 8/2012 Au ..... H03F 3/45475 327/538
8,531,171 B1 9/2013 Sutardja et al.
2006/0226892 A1 10/2006 Moro et al.
2006/0276986 A1 12/2006 Anderson et al.
2011/0006750 A1 1/2011 Sutardja et al.

FOREIGN PATENT DOCUMENTS

EP 1 712 973 A2 10/2006

OTHER PUBLICATIONS

European Search Report issued Apr. 30, 2014 in European Application 13198965, filed on Dec. 20, 2013 ( with English Translation).

Nema Talebbeydokhti et al. "Constant Transconductance Bias Circuit With an On-Chip Resistor", 2006 IEEE International Symposium on Circuits and Systems, 2006, 4 pages.

* cited by examiner

*Primary Examiner* — Hai L Nguyen

(74) *Attorney, Agent, or Firm* — Oblon, McClelland, Maier & Neustadt, L.L.P.

(57) ABSTRACT

The electronic circuit with a self-calibrated PTAT current reference includes a PTAT current generator dependent on at least one integrated resistor for supplying a PTAT output current. It further includes a reference current generator dependent on at least one switched capacitor resistor, for supplying a reference current. The reference current and the PTAT output current are compared in a comparator so as to digitally adapt the programmable integrated resistor, or to digitally adapt the dimensional ratio of the transistors of a current mirror in the PTAT current generator, to supply the adapted PTAT output current.

17 Claims, 1 Drawing Sheet

ELECTRONIC CIRCUIT WITH SELF-CALIBRATED PTAT CURRENT REFERENCE AND METHOD FOR ACTUATING THE SAME

This application claims priority from European patent application No. 13198965.9 filed Dec. 20, 2013, the entire disclosure of which is hereby incorporated herein by reference.

FIELD OF THE INVENTION

The invention concerns an electronic circuit provided with a self-calibrated PTAT current reference.

The invention also concerns the method for calibrating a PTAT current source of the electronic circuit.

BACKGROUND OF THE INVENTION

A PTAT current is a current proportional to absolute temperature. PTAT current sources are used in electronic circuits for supplying at least one temperature-dependent current. They may also be used in temperature sensor electronic circuits or in circuits for controlling functions in association with a time base.

Generally, to generate a PTAT current reference in an electronic circuit integrated in a silicon substrate, a conventional resistor is used in a current generation branch. The precision of such a resistor may vary by ±30% with respect to an estimated value according to the manufacturing method, for example of MOS type. It is often necessary to calibrate such a resistor at the end of the manufacturing process to ensure that the PTAT current reference is sufficiently precise, which is a drawback.

To calibrate the PTAT current reference, it is possible to use a network of resistors and programmable switches connected to the resistors to generate the current. This requires, at the end of any manufacturing process, measuring the current value and controlling the connection of several resistors to obtain the desired PTAT current reference. This complicates operations for adapting the current reference, which constitutes a drawback.

SUMMARY OF THE INVENTION

It is therefore an object of the invention to provide an electronic circuit provided with a self-calibrated PTAT current reference for improving the precision of the current reference independently of any variation in the electronic circuit manufacturing method and for overcoming the aforementioned drawbacks of the state of the art.

To this end, the invention concerns an electronic circuit with a self-calibrated PTAT current reference, the electronic circuit including a PTAT current generator dependent on at least one integrated resistor, for supplying a PTAT output current, characterized in that the electronic circuit further includes a reference current generator dependent on at least one switched capacitor resistor, for supplying a reference current, and in that the reference current and the PTAT output current are compared in a comparator so as to digitally adapt the integrated resistor, which is programmable, or to digitally adapt the dimensional ratio of transistors of a current mirror in the PTAT current generator, to supply the adapted PTAT output current.

Particular embodiments of the electronic circuit are defined in the dependent claims 2 to 13.

One advantage of the electronic circuit lies in the fact that it is possible to digitally adjust a network of resistors to generate a PTAT current reference, by comparing an output current of a PTAT current generation unit to a reference current. The reference current is generated in a reference current generator on the basis of an equivalent switched capacitor resistor.

Advantageously, it is also possible to digitally adapt the dimensional ratio of the current mirror transistors of the PTAT current generation unit by comparing the PTAT output current and the reference current. Several transistors can therefore be connected in parallel in a current mirror of the generation unit to supply the PTAT current.

Advantageously, the PTAT current reference of the electronic circuit can be automatically calibrated as soon as the electronic circuit is actuated. The calibration is performed by several successive dichotomous comparisons of the PTAT output current to the reference current. The comparison can be made in a comparator. The adaptation of the resistive value of the resistor network, or of the output current value, by connecting current mirror transistors in parallel, is controlled via a processing unit receiving data from the comparator.

Advantageously, after the PTAT current reference is calibrated in a first phase, the reference unit, which supplies the reference current for comparison with the PTAT output current, can be disconnected. The clocking signals of the switches of the switched capacitor resistor, which originate from a time base, are suppressed to reduce power consumption and prevent any spectral pollution. With this automatic calibration of the PTAT output current, the PTAT current may be at least 2 to 3 times more precise than a current of this type obtained with a standard, state-of-the-art, integrated resistor, while taking into account any matching errors of the current mirrors and current comparator.

To this end, the invention also concerns a method for calibrating a PTAT current source of the electronic circuit according to claim 1, wherein the method includes the steps of:

- supplying a PTAT output current of the PTAT current generator,
- supplying a reference current of the reference current generator,
- comparing the PTAT output current and the reference current, and
- digitally adapting the programmable integrated resistor, or a dimensional ratio of the transistors of a current mirror in the PTAT current generator.

Particular steps of the method are defined in the dependent claims 15 to 17.

BRIEF DESCRIPTION OF THE DRAWINGS

The objects, advantages and features of the electronic circuit with a self-calibrated PTAT current reference, and the method for calibrating a PTAT current source will appear more clearly in the following description made on the basis of at least one non-limiting embodiment, illustrated by the drawings, in which.

DETAILED DESCRIPTION OF THE INVENTION

In the following description, all those electronic components of the electronic circuit with a self-calibrated PTAT current reference that are well known to those skilled in this technical field will be described only in a simplified manner.

Figure 1:
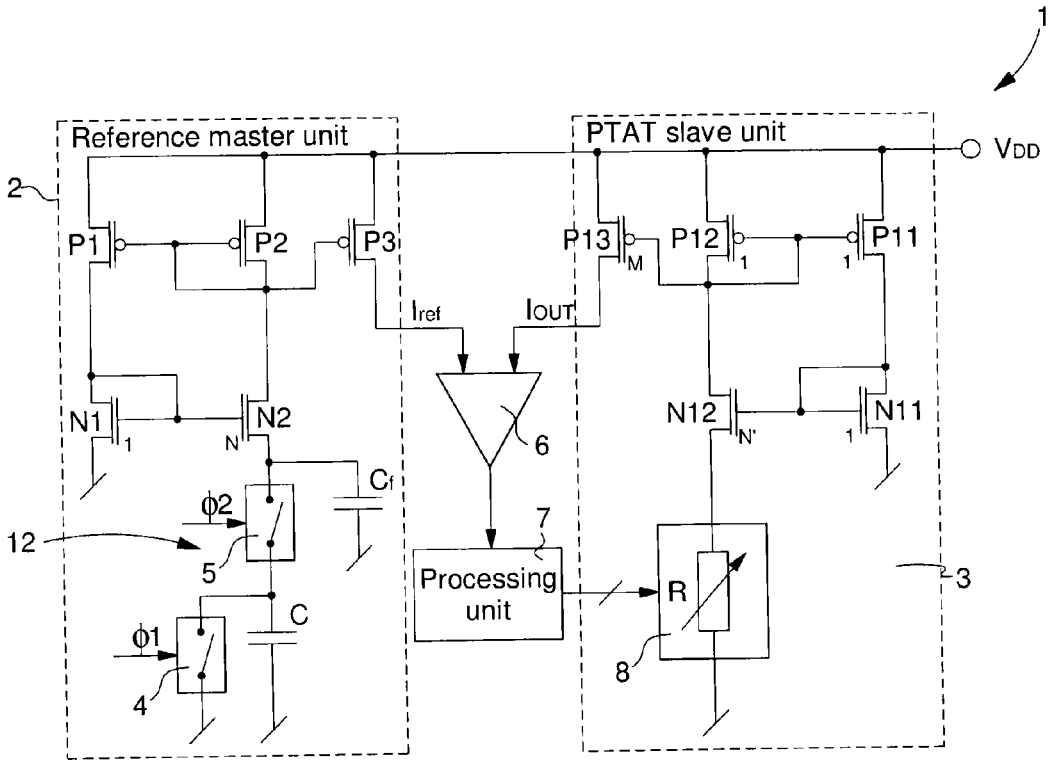
FIG. 1 shows a simplified view of the various components of the electronic circuit with a self-calibrated PTAT current reference according to the invention.

FIG. 1 shows a first embodiment of the electronic circuit 1. Electronic circuit 1 includes a master unit for supplying a calibration reference current $I_{ref}$ and a slave unit 3 for outputting a PTAT current reference $I_{OUT}$. Master unit 2 is a calibration reference current generator $I_{ref}$ dependent on a switched capacitor resistor 12. PTAT slave unit 3 is a current generator for outputting a PTAT current reference $I_{OUT}$. The PTAT current reference supplied by the PTAT generator is dependent on a resistor 8, whose resistive value R can be digitally adjusted as explained hereafter. However, it is also possible to digitally adapt the dimensional ratio of current mirror transistors in the PTAT current generator to supply the adapted PTAT current.

In order to adapt the PTAT output current $I_{OUT}$, a comparison is made in a comparator 6 between the calibration reference current $I_{ref}$ of master unit 2 and the PTAT output current $I_{OUT}$ of slave unit 3. In an ideal case, or after calibration, the PTAT output current $I_{OUT}$ is identical to the reference current $I_{ref}$. However, since the electronic circuit with resistor 8 is integrated in a semiconductor substrate, such as a silicon substrate, the resistive value of resistor 8 at the end of the MOS manufacturing process is not precise. Consequently, the PTAT output current $I_{OUT}$ is not identical to current $I_{ref}$. In these circumstances, the programmable resistor 8 is digitally adapted. Programmable resistor 8 can be adapted to become equivalent to switched capacitor resistor 12. According to the comparison between the two currents, output data from comparator 6 is supplied to a processing unit 7 so as to control digital adaptation of programmable resistor 8.

This programmable resistor 8 may be formed of a network of resistors and programmable switches. The resistor network includes several unit resistors in series and/or also partly in parallel. In the case of unit resistors in series, it is possible to provide switches connected in parallel to each unit resistor or groups of unit resistors, which is well known. The switches are controlled by digital signals or a binary control word originating from processing unit 7 so as to short-circuit a certain number of unit resistors to adapt the resistive value of programmable resistor 8.

Processing unit 7 therefore provides a binary word for controlling the switches and adapting the programmable resistor. A binary control word may be provided, for example a 16-bit word, for adjusting said programmable resistor 8. This makes it possible to ensure a precision of at least around ±5% with respect to the estimated resistance, whereas without calibration, the error of the programmable resistor may be close to ±30% as mentioned above. However, the precision must take account of matching errors in the current mirrors and current comparator 6, which may slightly reduce the precision.

To adapt programmable resistor 8, a dichotomy algorithm is preferably used in processing unit 7. This makes it possible to quickly converge on a final value of the programmable resistor. This adjustment is performed for a certain number of cycles according to the dichotomy algorithm. Once the PTAT output current $I_{OUT}$ becomes identical to reference current $I_{ref}$, the binary programming word for the programmable resistor is stored, particularly in a memory in processing unit 7.

The master unit or reference current generator 2 first of all includes a first current mirror formed of transistors N1, N2 of a first type of conductivity, for example NMOS transistors. Master unit 2 further includes a second current mirror formed of transistors P1, P2, P3 of a second type of conductivity, for example PMOS transistors. The first and second current mirrors are series-mounted between two terminals of a supply voltage source $V_{DD}$. The first current mirror is preferably connected to a first terminal of the voltage source, which in that case is an earth terminal, whereas the second current mirror is preferably connected to a second terminal of the voltage source, which is the high potential terminal $V_{DD}$.

According to the first embodiment of FIG. 1, the first current mirror includes a first NMOS transistor N1, whose source is connected to earth, and the drain and gate are connected to each other, and a second NMOS transistor N2, whose gate is connected to the gate of the first NMOS transistor N1 and whose source is connected to the switched capacitor resistor 12, and to a filtering capacitor $C_f$. Switched capacitor resistor 12 and filtering capacitor $C_f$ are also connected to the earth terminal in this embodiment.

The drain and gate of the first NMOS transistor N1 are connected to the drain of a first PMOS transistor P1 of the second current mirror. The drain of the second NMOS transistor N2 is connected to the gate and drain of a second PMOS transistor P2 of the second current mirror. The gate of the first PMOS transistor P1 is connected to the gate of the second PMOS transistor P2. The second current mirror further includes a third PMOS transistor P3 connected in parallel to the first and second PMOS transistors P1, P2. The gate of the third PMOS transistor P3 is connected to the gates of the first and second PMOS transistors P1, P2. The sources of the first, second and third PMOS transistors P1, P2, P3 are connected to the high potential terminal $V_{DD}$ of the voltage source. The drain of the third PMOS transistor P3 supplies the reference current $I_{ref}$ of reference current generator 2.

Since a switched capacitor resistor 12 is connected to the source of the second NMOS transistor N2, this NMOS transistor N2 is N times greater than the first NMOS transistor N1, which is considered to be a unit transistor. This means that the second NMOS transistor N2 is formed of N first NMOS transistors N1, where N is an integer number greater than or equal to 2. For example, N=6 could be selected, so as to have a second transistor N2 six times greater than the first transistor N1 or at least to have an MOS channel width six times greater than the MOS channel width of the first transistor N1.

The switched capacitor resistor 12 therefore includes a capacitor C, whose first electrode is connected to a first switch 4 and to a second switch 5. A second electrode of capacitor C is connected to the earth terminal. In the CMOS technology of the electronic circuit manufacturing method, this capacitor C may be a CMOS accumulation capacitor or a capacitor with a thin metal oxide electrode. This makes it possible to obtain a switched capacitor resistor 12 with a precision of around ±5%, whereas a standard integrated resistor 8 is made with a precision of around ±30%.

The first switch 4 is disposed between the first electrode of capacitor C and the earth terminal, whereas the second switch 5 is disposed between the first electrode of capacitor C and the source of the second NMOS transistor N2. The first switch 4 is controlled by a first control signal ϕ1, while the second switch 5 is alternately controlled by a second control signal ϕ2. First switch 4 is closed, when second switch 5 is open, in a first phase, and first switch 4 is open when second switch 5 is closed in a second phase. Each switch can advantageously be made in the form of a MOS transistor, for example an NMOS transistor, whose gate is controlled by the corresponding control signal.

Figure 2:
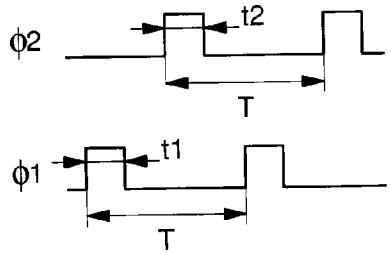
FIG. 2 shows a graph of the signals for clocking the switches in association with at least one capacitor for the master reference unit of the electronic circuit with a self-calibrated PTAT current reference according to the invention.

FIG. 2 shows a simplified view of the two control signals ϕ1 and ϕ2, which preferably do not overlap. These control signals may be obtained via a time base with a quartz oscillator. This quartz oscillator time base can also clock the operations of processing unit 7. Each control signal includes one rectangular control pulse per time period T. The rectangular pulse of the first control signal ϕ1 has a duration t1, which may be equal to T/4, while the rectangular pulse of the second control signal ϕ2 has a duration t2 which may also be equal to T/4. A time space of T/4 between the rectangular pulses of the first and second control signals ϕ1 and ϕ2 may also be envisaged. The rectangular pulse at the "1" state of first control signal ϕ1 controls the closing of the first switch 4, while the rectangular pulse at the "1" state of second control signal ϕ2 controls the closing of second switch 5.

The equivalent resistor, obtained by controlling first and second switches 4 and 5 with first and second control signals ϕ1 and ϕ2, is equal to T/C. T is the period of each control signal and C defines the capacitance of the capacitor. The resistive value of the equivalent resistor can be modified by modifying period T. This equivalent resistor of master unit 2 can be established with a precision of ±5% according to the method for manufacturing the electronic circuit integrated in a conventional silicon substrate. This equivalent resistor 12 may be identical to programmable resistor 8 digitally adjusted in slave unit 3 after calibration of the PTAT current.

After calibration of the PTAT output current $I_{OUT}$, reference current generator 2 and the time base for supplying control signals ϕ1 and ϕ2 can be disconnected. Only the calibrated PTAT current generator remains operational with a guaranteed PTAT output current $I_{OUT}$ precision, which may be at least ±5% of the expected value.

In a similar manner to master unit 2, the PTAT slave unit 3, or PTAT current generator 3 includes a first current mirror formed of transistors N11, N12 of a first type of conductivity, for example NMOS transistors. The PTAT slave unit 3 further includes a second current mirror formed of transistors P11, P12, P13 of a second type of conductivity, for example PMOS transistors. The first and second current mirrors are series-mounted between two terminals of a supply voltage source $V_{DD}$. The first current mirror is preferably connected to the first terminal of the voltage source, which in that case is an earth terminal, whereas the second current mirror is preferably connected to the second terminal of the voltage source, which is the high potential terminal $V_{DD}$.

As shown in FIG. 1, the first current mirror includes a first NMOS transistor N11, whose source is connected to earth, and whose drain and gate are connected to each other, and a second NMOS transistor N12, whose gate is connected to the gate of the first NMOS transistor N11 and whose source is connected to programmable resistor 8, which is also connected to the earth terminal.

The drain and the gate of the first NMOS transistor N11 are connected to the drain of a first PMOS transistor P11 of the second current mirror. The drain of the second NMOS transistor N12 is connected to the gate and drain of a second PMOS transistor P12 of the second current mirror. The gate of the first PMOS transistor P11 is connected to the gate of the second PMOS transistor P12. The second current mirror of the PTAT slave unit 3 further includes a third PMOS transistor P13 connected in parallel to the first and second PMOS transistors P11, P12. The gate of the third PMOS transistor P13 is connected to the gates of the first and second PMOS transistors P11, P12. The sources of the first, second and third PMOS transistors P11, P12, P13 are connected to the high potential terminal $V_{DD}$ of the voltage source. The drain of the third PMOS transistor P13 supplies the PTAT output current $I_{OUT}$ of PTAT current generator 3.

Since programmable resistor 8 is connected to the source of the second NMOS transistor N12, this NMOS transistor N2 is N' times greater than the first NMOS transistor N11, which is considered to be a unit transistor. This means that the second NMOS transistor N12 is formed of N' first NMOS transistors N1, where N' is an integer number greater than or equal to 2. For example, N'=6 could be selected as for the second transistor N2 of master unit 2. This makes it possible to obtain a second transistor N12 six times greater than the first transistor N11 or at least to obtain an MOS channel width six times greater than the MOS channel width of the first transistor N11. However, the number N' may be different from number N.

It is also to be noted that the third PMOS transistor P13 may also be M times greater than the first PMOS transistor P11 and the second PMOS transistor P12 of the second current mirror of PTAT slave unit 3. M is an integer number greater than or equal to 1. If M is equal to 1, programmable resistor 8, which has been adapted, may be equivalent to switched capacitor resistor 12 of master unit 2.

According to a variant of the electronic circuit 1 (not shown), instead of the third PMOS transistor P13, a set of unit transistors combined with digitally controlled switches may be used. Instead of programmable resistor 8, it is possible to envisage using a resistor 8 of defined value, and digitally adapting a dimensional ratio of the PMOS transistors of the second current mirror, which supply the PTAT output current $I_{OUT}$. A binary adaptation word is supplied at the end of the calibration cycles by the dichotomy algorithm. This binary word for configuring the set of transistors is stored in processing unit 7.

It is also possible to envisage inverting the electronic structure of master unit 2 and slave unit 3. The first current mirror with the NMOS transistors can be replaced by a first current mirror with PMOS transistors, which is connected to the high potential terminal $V_{DD}$, while the second current mirror with the PMOS transistors can be replaced by a second current mirror with NMOS transistors, which is connected to the earth terminal. In such case, the switched capacitor resistor 12 and programmable resistor 8 are connected to the high potential terminal $V_{DD}$.

It is also possible to envisage having several switched capacitor resistors disposed in parallel and each controlled by two control signals for each switched capacitor resistor.

From the description that has just been given, several variants of the electronic circuit with a PTAT reference current can be devised by those skilled in the art without departing from the scope of the invention defined by the claims. The transistors of current mirrors can be also bipolar transistors.

What is claimed is:

1. An electronic circuit with a self-calibrated PTAT current reference, the electronic circuit including a PTAT current generator dependent on at least one integrated resistor, for supplying a PTAT output current, wherein the electronic circuit further includes a reference current generator dependent on at least one switched capacitor resistor, for supplying a reference current, and wherein the reference current and the PTAT output current are compared in a comparator so as to digitally adapt the integrated resistor, which is programmable, or to digitally adapt the dimensional ratio of transistors of a current mirror in the PTAT current generator, to supply the adapted PTAT output current.

2. The electronic circuit according to claim 1, wherein the comparator is connected to a processing unit to receive output data from the comparator, resulting from the comparison between the reference current and the PTAT output current to control the digital adaptation of the programmable resistor or of the dimensional ratio of the transistors.

3. The electronic circuit according to claim 2, wherein the processing unit is intended to implement a dichotomy algorithm for the cyclical adaptation of the programmable resistor or of the dimensional ratio of the transistors, wherein the processing unit includes a memory for storing a final binary word for the digital adaptation of the programmable resistor or of the dimensional ratio of the transistors.

4. The electronic circuit according to claim 1, wherein the reference current generator includes a first current mirror formed of transistors of a first type of conductivity, and a second current mirror formed of transistors of a second type of conductivity, the first and second current mirrors being series-mounted between two terminals of a supply voltage source, and wherein the switched capacitor resistor is connected to a source or a transmitter of a transistor of the first current mirror and in series with the first and second current mirrors between the terminals of the voltage source.

5. The electronic circuit according to claim 4, wherein the first current mirror includes NMOS transistors, and in that the second current mirror includes PMOS transistors.

6. The electronic circuit according to claim 5, wherein the first current mirror includes a first NMOS transistor and a second NMOS transistor, in that the first NMOS transistor includes a source connected to an earth terminal, and a gate connected to a drain, wherein the second NMOS transistor has a source connected to the switched capacitor resistor, which is connected to the earth terminal, a gate connected to the gate of the first NMOS transistor, wherein the second current mirror includes a first PMOS transistor, a second PMOS transistor and a third PMOS transistor, the three PMOS transistors each having a source connected to a high potential terminal of the voltage source and gates connected to each other, wherein the first PMOS transistor includes a drain connected to the gate and to the drain of the first NMOS transistor, wherein the second PMOS transistor includes a drain connected to the gate and to a drain of the second NMOS transistor, and wherein the third PMOS transistor includes a drain for supplying the reference current.

7. The electronic circuit according to claim 6, wherein the second NMOS transistor is N times greater than the first NMOS transistor, where N is an integer number greater than or equal to 2, and preferably equal to 6.

8. The electronic circuit according to claim 4, wherein the switched capacitor resistor includes a capacitor, a first switch connected in parallel to the capacitor, and a second switch connected between an electrode of the capacitor and the source or the transmitter of the transistor of the first current mirror, and wherein the first switch is controlled by a first control signal, and in that the second switch is controlled by a second control signal, the first and second control signals being generated via a time base and arranged such that the first switch is open when the second switch is closed, and vice versa.

9. The electronic circuit according to claim 1, wherein the PTAT current generator includes a first current mirror formed of transistors of a first type of conductivity, and a second current mirror formed of transistors of a second type of conductivity, the first and second current mirrors being series-mounted between two terminals of a supply voltage source, and wherein the resistor is connected to a source or a transmitter of a transistor of the first current mirror and in series with the first and second current mirrors between the terminals of the voltage source.

10. The electronic circuit according to claim 9, wherein the first current mirror includes NMOS transistors, and wherein the second current mirror includes PMOS transistors.

11. The electronic circuit according to claim 10, wherein the first current mirror includes a first NMOS transistor and a second NMOS transistor, wherein the first NMOS transistor includes a source connected to an earth terminal, and a gate connected to a drain, wherein the second NMOS transistor has a source connected to the resistor, which is connected to the earth terminal, a gate connected to the gate of the first NMOS transistor, wherein the second current mirror includes a first PMOS transistor, a second PMOS transistor and a third PMOS transistor, the three PMOS transistors each having a source connected to a high potential terminal of the voltage source and gates connected to each other, wherein the first PMOS transistor includes a drain connected to the gate and to the drain of the first NMOS transistor, wherein the second PMOS transistor includes a drain connected to the gate thereof and to a drain of the second NMOS transistor, and wherein the third PMOS transistor includes a drain for supplying the reference current.

12. The electronic circuit according to claim 11, wherein the second NMOS transistor is N' times greater than the first NMOS transistor, where N' is an integer number greater than or equal to 2, and preferably equal to 6.

13. The electronic circuit according to claim 11, wherein the third PMOS transistor is formed of a set of unit transistors, which are combined with digitally controlled switches to adapt the PTAT output current.

14. A method for calibrating a PTAT current source of the electronic circuit according to claim 1, wherein the method includes the steps of:

supplying a PTAT output current of the PTAT current generator, supplying a reference current of the reference current generator, comparing the PTAT output current and the reference current, and digitally adapting the programmable integrated resistor, or a dimensional ratio of the transistors of a current mirror in the PTAT current generator.

15. The method according to claim 14, wherein the digital adaptation is performed over a certain number of cycles according to a dichotomy algorithm in a processing unit.

16. The method according to claim 15, wherein the digital word supplied by the processing unit is stored in a memory of the processing unit at the end of the PTAT output current adaptation cycles.

17. The method according to claim 15, wherein at the end of the PTAT output current adaptation cycles, the reference current generator is disconnected, as the supply of control signals from the switched capacitor resistor.

* * * * *